US011493947B2

(12) United States Patent
Palmer

(10) Patent No.: US 11,493,947 B2
(45) **Date of Patent: *Nov. 8, 2022**

(54) KEYBOARD SUSTAIN PEDAL STABILIZER

(71) Applicant: Fred Palmer, Detroit, MI (US)

(72) Inventor: Fred Palmer, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/998,490

(22) Filed: Aug. 20, 2020

(65) Prior Publication Data

US 2020/0379499 A1 Dec. 3, 2020

Related U.S. Application Data

(63) Continuation-in-part of application No. 16/270,428, filed on Feb. 7, 2019, now Pat. No. 10,755,680.

(60) Provisional application No. 62/631,671, filed on Feb. 17, 2018.

(51) Int. Cl.

| | |
|---|---|
| ***G05G 1/44*** | (2008.04) |
| ***G10H 1/34*** | (2006.01) |
| ***G10C 3/26*** | (2019.01) |

(52) U.S. Cl.

CPC ..... *G05G 1/44* (2013.01); *G10C 3/26* (2013.01); *G10H 1/348* (2013.01)

(58) Field of Classification Search

CPC ..... G05G 1/44; G05G 1/483; G10H 1/348; G10C 3/26; G10C 3/14

See application file for complete search history.

(56) References Cited

U.S. PATENT DOCUMENTS 10,147,403 B1 * 12/2018 Perry, Jr. ..... G10B 3/14
10,755,680 B2 * 8/2020 Palmer ..... G10C 3/26

* cited by examiner

*Primary Examiner* — Kimberly R Lockett
(74) *Attorney, Agent, or Firm* — Gerald R. Black, Esq.

(57) ABSTRACT

A keyboard sustain pedal stabilizer is for use with a keyboard sustain foot pedal. The keyboard sustain pedal stabilizer comprises a stabilizer base, and a pedal-retention area in cooperative engagement with the stabilizer base. The pedal-retention area includes a retaining structure, the retaining structure enabling secure retention of the keyboard sustain foot pedal within the pedal-retention area. The retention structure may be an end-wall in combination with a pair of opposing sidewalls, a recess in combination with a pair of opposing sidewalls, or a recess in combination with an end-wall. The keyboard sustain pedal stabilizer may also include an expanded position and a retracted position, the expanded position being for cooperative engagement with the keyboard sustain pedal, the retracted position being for transporting the keyboard sustain pedal stabilizer. The under surface of the stabilizer has non-slipping properties.

20 Claims, 11 Drawing Sheets

KEYBOARD SUSTAIN PEDAL STABILIZER

CROSS-REFERENCE TO RELATED APPLICATIONS

This Application is a Continuation-in-Part and claims priority to U.S. patent application Ser. No. 16/270,428 (Palmer), entitled "Keyboard Sustain Pedal Stabilizer", filed on Feb. 7, 2019, now U.S. Pat. No. 10,755,680, and U.S. Provisional Application No. 62/631,671 (Palmer), entitled "Keyboard Sustain Pedal Stabilizer", filed on Feb. 17, 2018, and U.S. Design Pat. No. 880578 (Palmer), entitled "Keyboard Sustain Pedal Stabilizer" filed on Feb. 15, 2018.

FIELD OF USE

The present invention relates to keyboard sustain foot pedals, and particularly to a keyboard sustain pedal stabilizer for use with a keyboard sustain foot pedal.

BACKGROUND OF THE INVENTION

Keyboards have the advantage over acoustic pianos in terms of portability, versatility, and ease of amplification but many keyboards lack the capacity for expression of pianos. With the right foot pedal, however, a keyboard can communicate compositions from the likes of Debussy and even achieve effects far beyond the capabilities of the highest-quality concert pianos. Currently, there are available a selection of keyboard sustain, volume and expression pedals sure to contain the perfect accessory to take keyboard performances to the next level.

Shoes, including athletic shoes, work boots, dress shoes, overshoes, and all manner of footwear, provide poor traction on many wet surfaces. The difficulties of moving across a slippery surface, often result in inconvenience and injury. Slips, falls, and resultant injuries are typically caused by a lack of good footing. And even if a musician does not actually fall, the need to maintain one's proper balance on a wet or a slippery surface may cause loss of rhythm for a musician.

A keyboard sustain pedal is known for use with modern pianos and keyboards. When pressed, the keyboard sustain pedal sustains all the damped strings on the piano by moving all the dampers away from the strings and enabling them to vibrate freely. All notes played will continue to sound until the vibration naturally ceases, or until the pedal is released.

Conventionally, musicians use foot pedals for various musical effects. While playing musical instruments and depressing the foot pedals, the musician may find that the foot pedal has slipped from the original position. The musician, while playing, will need a foot to reach and return the foot pedal to the original position.

Some prior art regarding this invention includes:

U.S. Pat. No. 7,511,212 (Chang) discloses a musical instrument stand assembly with a foldable pedal. The musical instrument stand assembly with a foldable pedal includes a main stand body, and the main stand body includes a main rod, and the bottom of the main rod includes two support rods each with a recession, and the recession includes a first circular serration; two side frames, and a sidewall of each side frame includes a protrusion and a second circular serration at the protrusion, and each side frame is installed by engaging each protrusion with the recession of each support rod, such that the first and second circular serrations are engaged with each other. With the design of rotably engaging the two side frames and the two support rods, the main stand body of the musical instrument has the function of adjusting its inclination with respect to a vertical position, and the effect of conveniently folding the pedal of the musical instrument.

U.S. Pat. No. 7,655,854 (Wang) discloses a pedal support for percussion instruments. The pedal support comprises a frame including a perpendicularly door-shaped supporting portion and a horizontal mounting portion, the supporting portion being fixed on the mounting member and including two ends, each having a positioning hole formed thereon, the two positioning holes axially coupling with two L-shaped connecting members individually so that the connecting members allow to swing between a first position and a second position, and each of the connecting members including a retaining slot; and a U-shaped piece being pivotally connected to one end of the mounting portion, wherein as the connecting members are located at the first position, the connecting members and the frame are in a retracted status, as the connecting members are located at the second position.

U.S. Pat. No. 9,858,904 (Gold) discloses an insertable percussion system. The system includes a percussion instrument; an inserting/retracting coupled to the percussion instrument for moving the first percussion instrument to a desired position with respect to a second percussion instrument; the inserting/retracting mechanism including a motor, an input device for receiving an operation instruction and generating an operation signal based on the operation instruction, a feedback mechanism for obtaining position information of the first percussion instrument and generating a feedback signal representative of the position information, and a controller electrically coupled to the input device, the motor. The feedback mechanism for actuating the motor is based on the operation signal and the feedback signal.

Typically, musicians try to prevent the foot pedal from moving and sliding on the floor by placing a brick or some other heavy object behind the keyboard sustain foot pedal.

What is needed is a keyboard sustain pedal stabilizer that does not have any moving parts, has no connection to the keyboard stand, is easy to use, requires no set-up time, is compact and readily transportable, and is compatible with essentially any keyboard sustain foot pedal.

The primary objective of the present invention is to provide a keyboard sustain pedal stabilizer that stabilizes the keyboard sustain foot pedal.

Another objective of the present invention is to provide an attachable pedal cover comprised of a rubber-type pad with an anti-slip means for preventing slipping of the keyboard sustain pedal stabilizer engaging in a stable manner with the floor.

It is another objective of the present invention to provide a keyboard sustain pedal stabilizer for a keyboard sustain foot pedal that is compatible with floors having varying textures and hardness.

SUMMARY OF THE INVENTION

The keyboard sustain pedal stabilizer of the present invention addresses these needs and objectives.

A hinge, as used herein, is a mechanical bearing that connects two solid objects, typically allowing rotation between them. Two objects connected by an ideal hinge rotate relative to each other about a fixed axis of rotation.

A first preferred embodiment of the keyboard sustain pedal stabilizer of the present invention is for use with a keyboard sustain foot pedal. The keyboard sustain pedal stabilizer comprises a stabilizer base, a pedal-retention area in cooperative engagement relative to the stabilizer base, and a hinge affixing the stabilizer base to the pedal-retention area. The pedal-retention area includes a retaining structure, the retaining structure enabling secure retention of the keyboard sustain foot pedal within the pedal-retention area. The hinge enabling rotation between the stabilizer base and the pedal-retention area. The retaining structure is comprised of a pair of sidewalls and an end-wall.

A second preferred embodiment of the keyboard sustain pedal stabilizer of the present invention comprises a stabilizer base, a pedal-retention area in cooperative engagement relative to the stabilizer base, and a hinge affixing the stabilizer base to the pedal-retention area. The pedal-retention area includes a retaining structure, the retaining structure enabling secure retention of the keyboard sustain foot pedal within the pedal-retention area. The hinge enables rotation between the stabilizer base and the pedal-retention area. The retaining structure is comprised of a pair of sidewalls and a recess in the pedal-retention area that secures the keyboard sustain foot pedal within the keyboard sustain pedal stabilizer.

A third preferred embodiment of the keyboard sustain pedal stabilizer of the present invention comprises a stabilizer base, and a pedal-retention area in cooperative engagement relative to the stabilizer base. The pedal-retention area includes a retaining structure, the retaining structure enabling secure retention of the keyboard sustain foot pedal within the pedal-retention area. The keyboard sustain pedal stabilizer is made of a natural rubber material, a synthetic rubber material, or a blend of one or more natural rubber materials and one or more synthetic rubber materials. The keyboard sustain pedal stabilizer has an underside. The underside has a non-slip surface to stabilize the keyboard sustain pedal stabilizer on the floor of the venue.

As used herein, a "keyboard" instrument includes any instrument equipped with a keyboard, a row of levers which are pressed by the fingers. The most common of these are the piano, organ, and various electronic keyboards, including synthesizers and digital pianos. Other keyboard instruments, which are struck idiophones operated by a keyboard, which are usually housed in bell towers or belfries of churches or municipal buildings. In its broadest sense, the term keyboard instrument is applied to any instrument equipped with a keyboard and thus may be used to refer to accordions, percussion instruments and many electronic instruments—such as by way of non-limiting example, a celesta, a harpsichord, a virginal, and a carillon, a Moog synthesizer, a spinet keyboard and an Ondes Martenot.

Preferably, the keyboard sustain pedal stabilizer of the present invention does not connect to the keyboard instrument in any way. The keyboard sustain pedal stabilizer is compatible with substantially any keyboard sustain pedal. The keyboard sustain pedal stabilizer may be made by a 3D printing process. In one preferred embodiment, the keyboard sustain pedal stabilizer is a black rigid polypropylene material, such as an oriented polyethylene terephthalate, or a simulated polypropylene material and preferably having a non-aggressive tread pattern.

For a complete understanding of the keyboard sustain pedal stabilizer of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
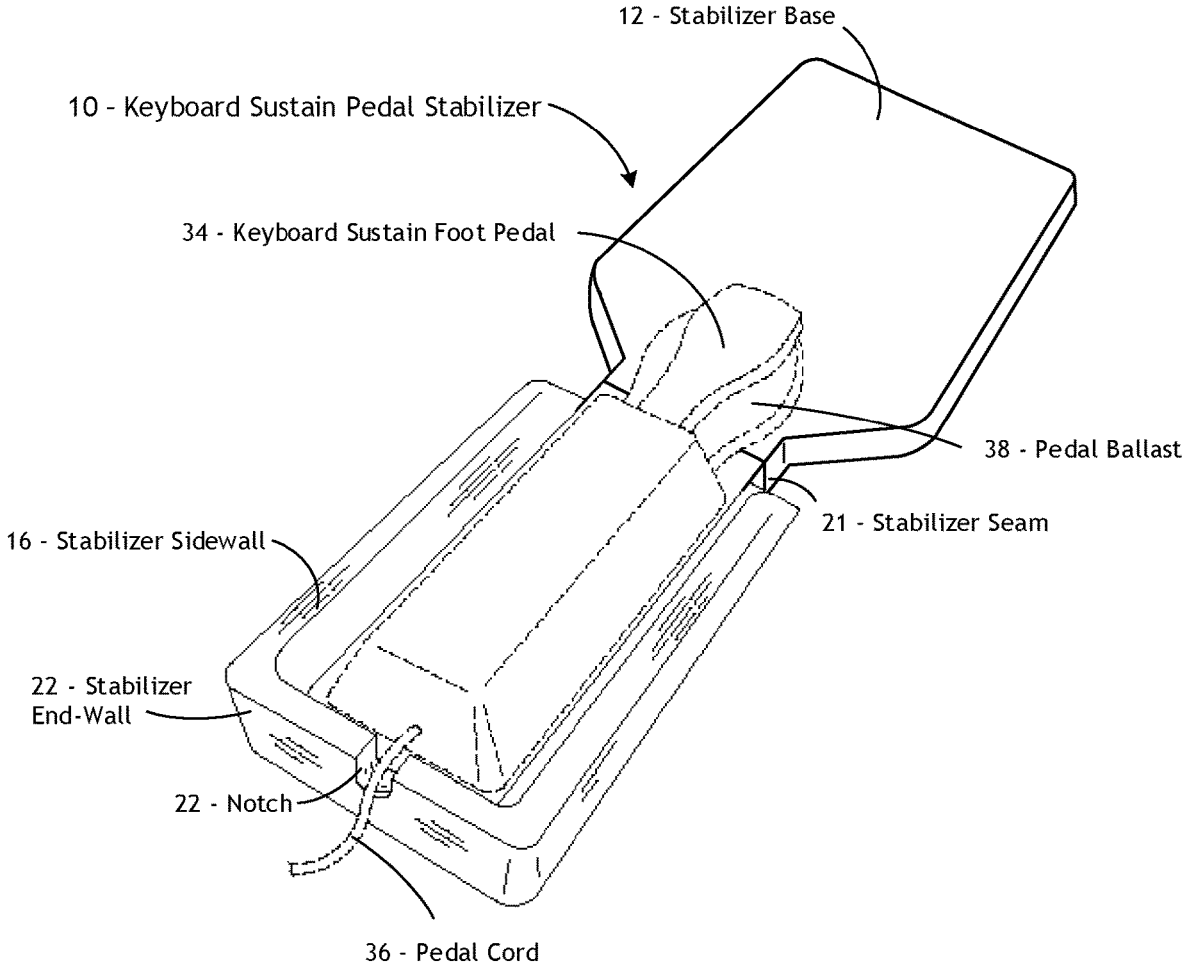
FIG. 1 depicts an assembly view of a keyboard sustain foot pedal mounted upon a first preferred embodiment the keyboard sustain pedal stabilizer of the present invention.

Referring now to the drawings, FIG. 1 depicts a keyboard instrument sustain foot pedal [34] (in dotted lines) positioned on a first preferred embodiment of the keyboard sustain pedal stabilizer of the present invention [10].

The keyboard sustain pedal stabilizer of the present invention [10] is for use with a keyboard sustain foot pedal [34]. The keyboard sustain pedal stabilizer [10] comprises a stabilizer base [12], and a pedal-retention area [13] for retaining the keyboard sustain foot pedal [32].

Figure 2:
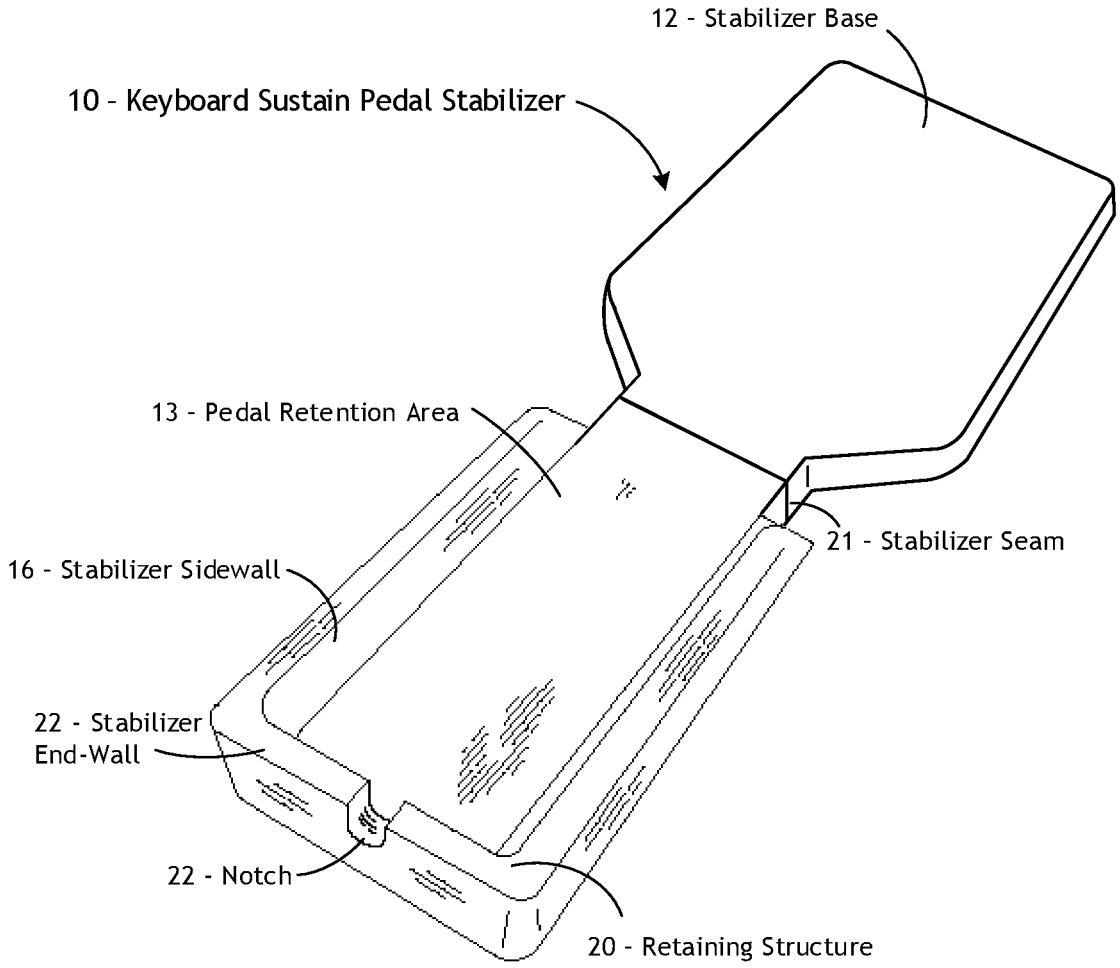
FIG. 2 depicts an assembly view of the keyboard sustain pedal stabilizer of FIG. 1.

The keyboard sustain foot pedal [34] is securely retained onto the keyboard sustain pedal stabilizer of the present invention [10] by a retaining structure [20]. The retaining structure as depicted in FIGS. 1 and 2 comprises a pair of sidewalls [16] joined by an end-wall [22].

The pedal-retention frame area [13], the pair of sidewalls [16], and the end-walls [22] are preferably made of a single piece of polymer material, which are preferably a plurality of rows of aligned nodules [23] protruding upwardly on the underside of the stabilizer base [12] and the pedal retention area [13]. Also, the keyboard sustain pedal stabilizer of the present invention [10] preferably has a non-slip underside [19] comprising a plurality of nodules [23].

However, as used herein, non-slip means any suitable forms, such as cross-hatching, or a series of closely spaced nubs which extend over the underside of the keyboard sustain pedal stabilizer of the present invention [10], or other indentations such as swirls which provide an anti-slip surface across the underside [19] of the keyboard sustain pedal stabilizer of the present invention [10], which form a non-slip or textured surface that is adapted to provide a non-slip engagement with the floor.

Figure 3:
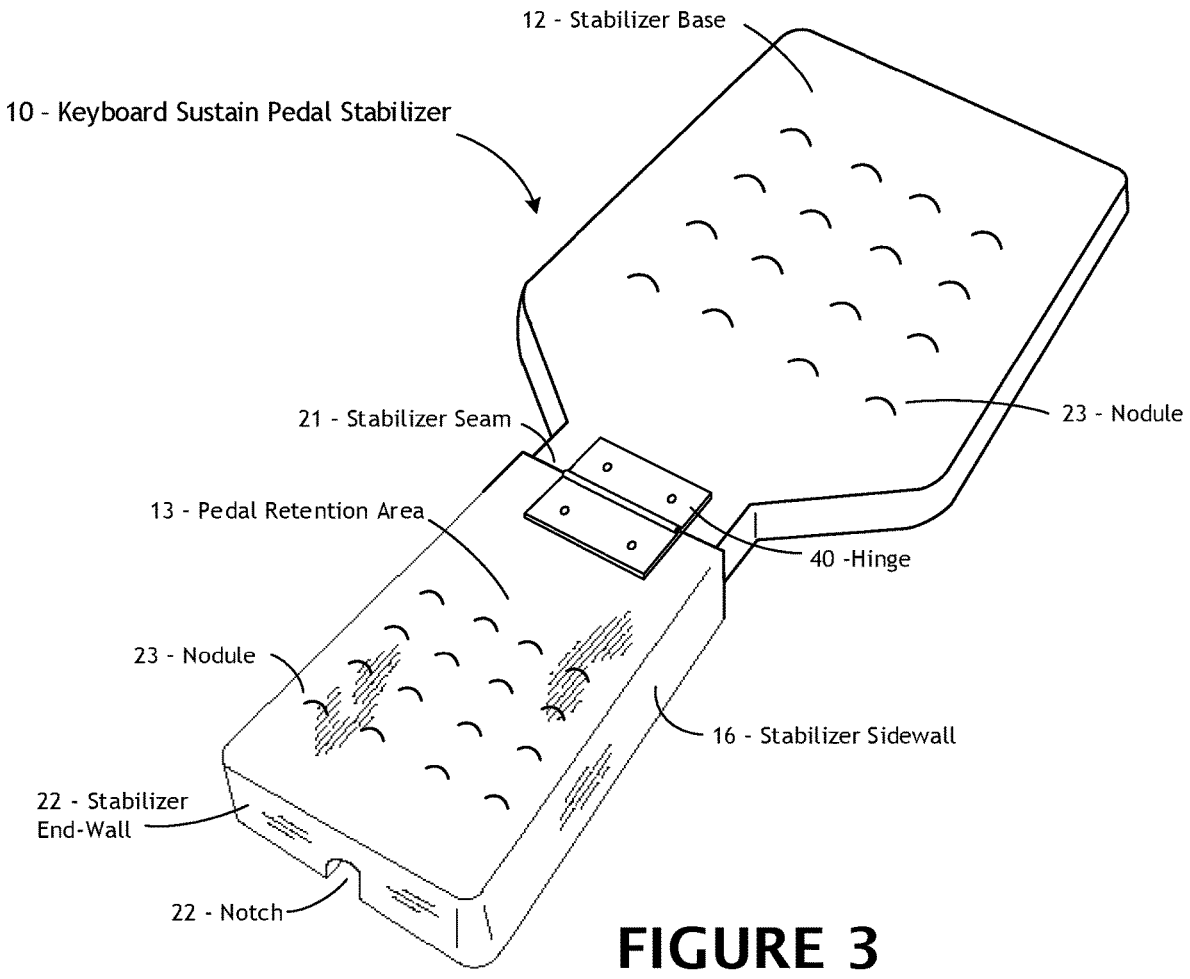
FIG. 3 depicts a bottom view of the keyboard sustain pedal stabilizer of FIG. 1.

Referring now to FIG. 3, the keyboard sustain pedal stabilizer of the present invention [10] is severed into a stabilizer base [12] and a pedal retention area [13] along a stabilizer seam [21]. The hinge [40] is preferably a conventional door hinge comprising a pair of flats, and a round center section. The first flat is secured to the underside [19] of the keyboard sustain pedal stabilizer of the present invention [10] by screw-type fasteners and aligned with the edge of the stabilizer base [12] and the second flat is secured to the edge of the pedal retention area [13]. A hinge connects the stabilizer base [12] and the pedal retention area [13] along the stabilizer seam [21], enabling rotation between them.

The keyboard sustain foot pedal [34] preferably includes a pedal cord [36] for securing to a keyboard (not shown). A notch [24] is disposed in the end-wall [22] for retaining and positioning the cord [36].

The keyboard sustain pedal stabilizer [10] is preferably made of a darkened or black rigid polypropylene material, such as an oriented polyethylene terephthalate, or a simulated polypropylene material and preferably having a non-aggressive tread pattern.

Figure 4:
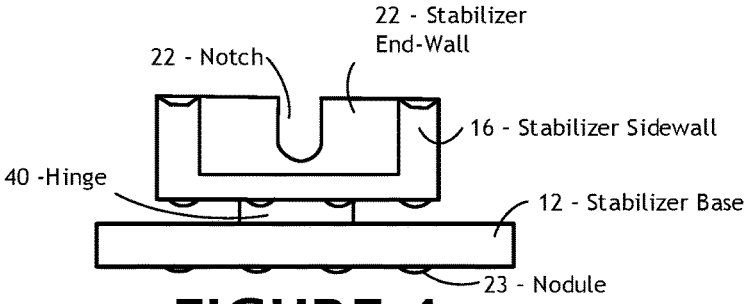
FIG. 4 depicts an end view of the keyboard sustain pedal stabilizer of FIG. 1, the keyboard sustain pedal stabilizer being in a folded position ready for transport.
Figure 5:
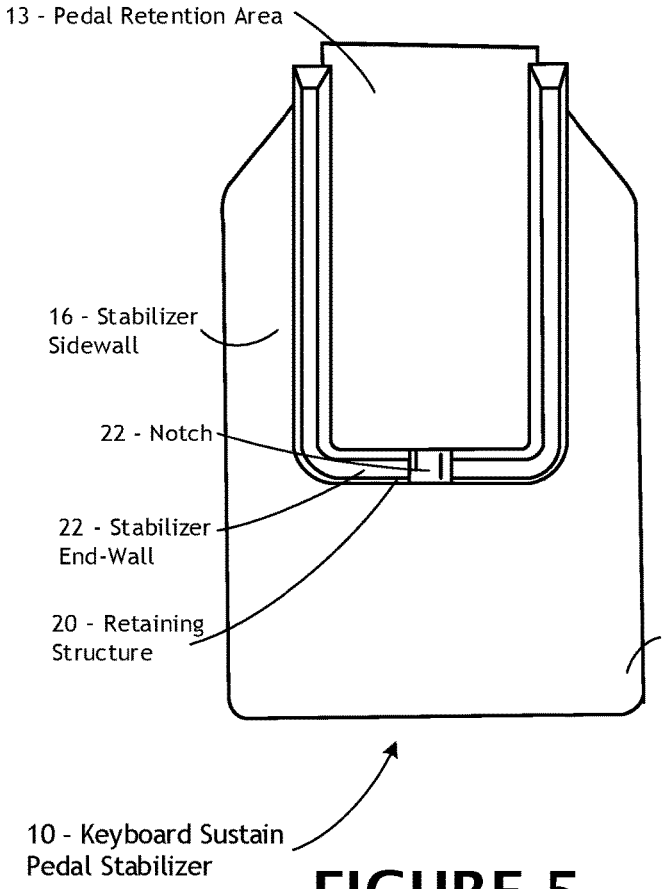
FIG. 5 depicts a top view of the keyboard sustain pedal stabilizer of FIG. 1, the keyboard sustain pedal stabilizer being in a folded position ready for transport.
Figure 6:
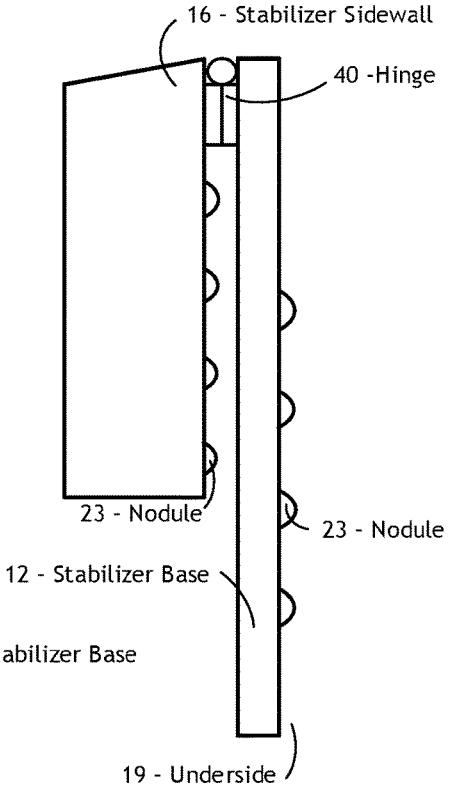
FIG. 6 depicts a side view of the keyboard sustain pedal stabilizer of FIG. 1, the keyboard sustain pedal stabilizer being in a folded position ready for transport.

FIG. 4 depicts an end view of the keyboard sustain pedal stabilizer [10] of FIG. 1, FIG. 5 depicts a top view of the keyboard sustain pedal stabilizer [10] of FIG. 1, and FIG. 6 depicts a side view of the keyboard sustain pedal stabilizer [10] of FIG. 1, the keyboard sustain pedal stabilizer [10] being in a folded position ready for transport.

Figure 7:
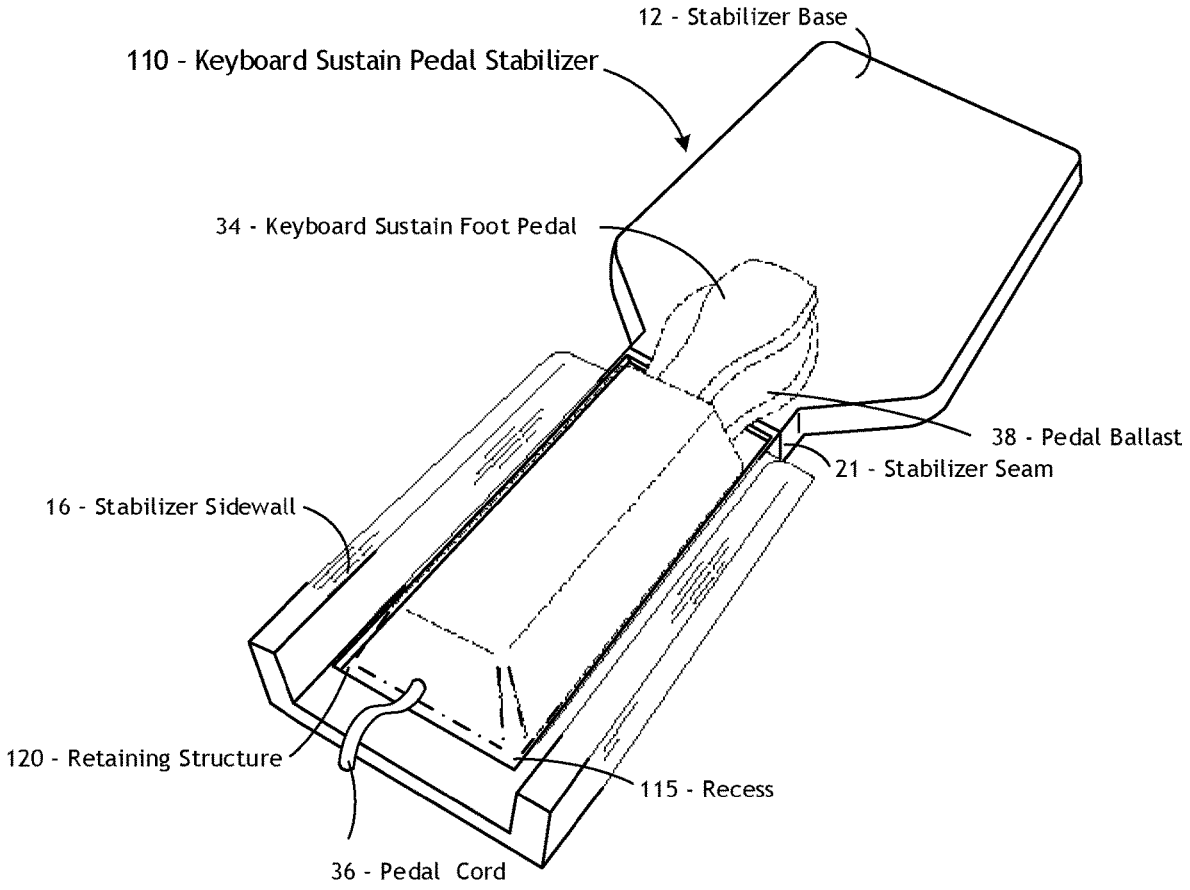
FIG. 7 depicts an assembly view of a keyboard sustain foot pedal mounted upon a second preferred embodiment the keyboard sustain pedal stabilizer of the present invention.
Figure 8:
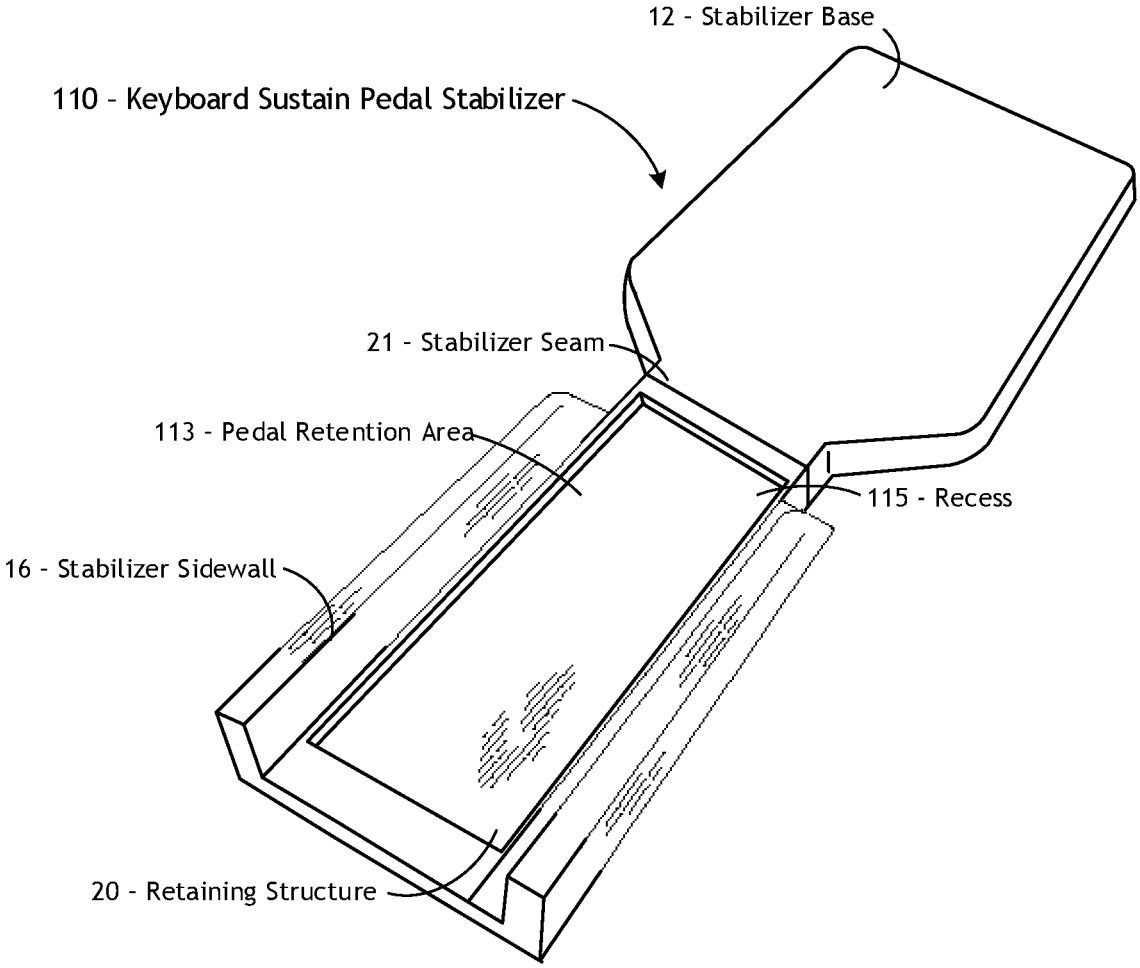
FIG. 8 depicts an assembly view of the keyboard sustain pedal stabilizer of FIG. 7.
Figure 9:
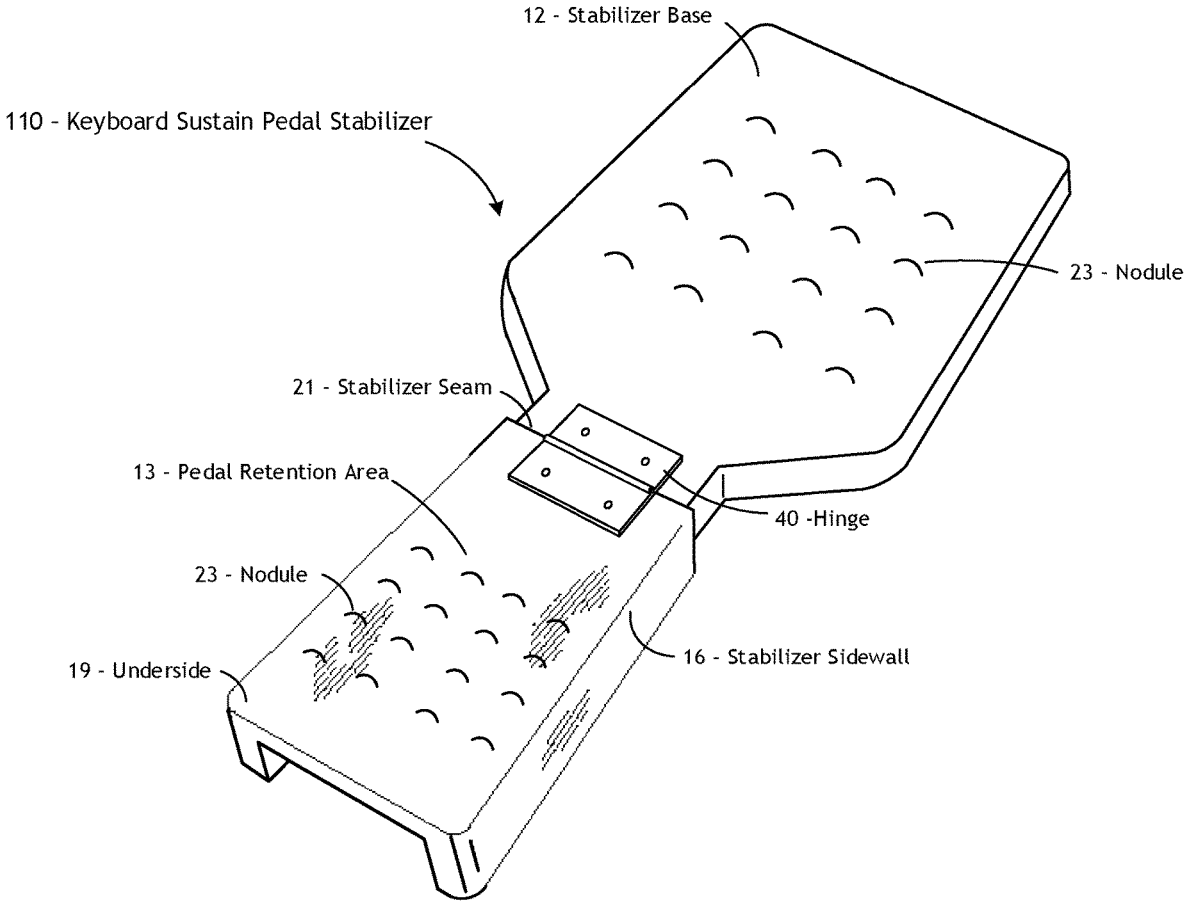
FIG. 9 depicts a bottom view of the keyboard sustain pedal stabilizer of FIG. 7.

FIG. 7 depicts an assembly view of a keyboard sustain foot pedal [34] mounted upon a second preferred embodiment the keyboard sustain pedal stabilizer [110] of the present invention. FIG. 8 depicts an assembly view of the keyboard sustain pedal stabilizer [110] of FIG. 7. FIG. 9 depicts a bottom view of the keyboard sustain pedal stabilizer [110] of FIG. 7.

FIG. 7 depicts the keyboard sustain foot pedal [34] (in phantom) positioned in a recess [115] that is part of a retaining structure [120] on the keyboard sustain pedal stabilizer [110]. FIG. 8 depicts the keyboard sustain pedal stabilizer [110] with the keyboard sustain foot pedal [34] removed from the recess [115] within the pedal-retaining structure [113].

Here, the retaining structure is a recess [126] in pedal retention area [13] which prevents the keyboard sustain foot pedal [34] from sliding backward over the pedal retention area [13] during use.

The pedal-retention frame area [13], the pair of sidewalls [16], and the end-walls [22] are preferably made of a single piece of polymer material, which are preferably a plurality of rows of aligned nodules [23] protruding upwardly on the underside of the stabilizer base [12] and the pedal retention area [13]. Also, the keyboard sustain pedal stabilizer of the present invention [110] preferably has a non-slip underside [19] comprising a plurality of nodules [23].

Referring now to FIG. 9, the keyboard sustain pedal stabilizer of the present invention [110] is severed into a stabilizer base [12] and a pedal retention area [13] along a stabilizer seam [21]. The hinge [40] is preferably a conventional door hinge comprising a pair of flats, and a round center section. The first flat is secured to the underside [19] of the keyboard sustain pedal stabilizer of the present invention [110] by screw-type fasteners and aligned with the edge of the stabilizer base [12] and the second flat is secured to the edge of the pedal retention area [13]. A hinge connects the stabilizer base [12] and the pedal retention area [13] along the stabilizer seam [21], enabling rotation between them.

Figure 10:
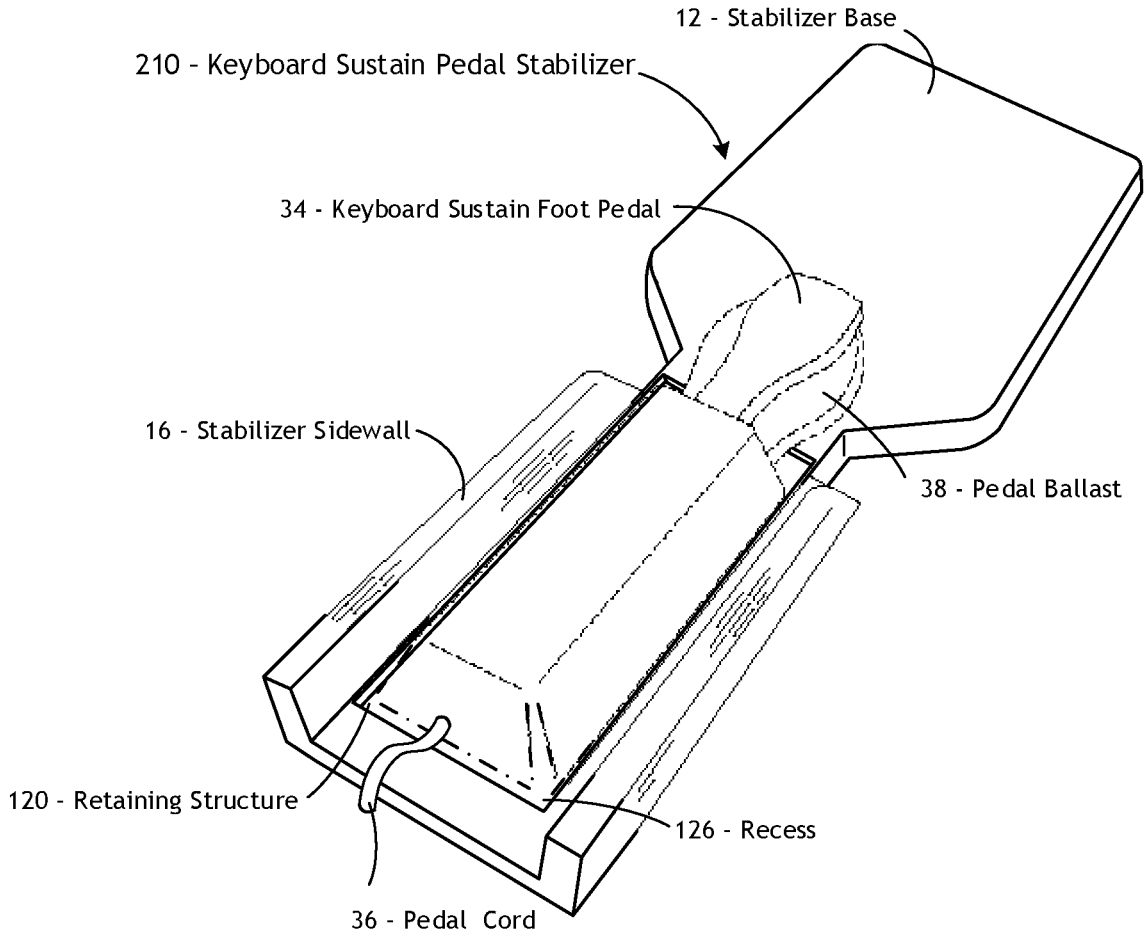
FIG. 10 depicts an assembly view depicting a keyboard sustain foot pedal mounted upon a third preferred embodiment the keyboard sustain pedal stabilizer of the present invention.
Figure 11:
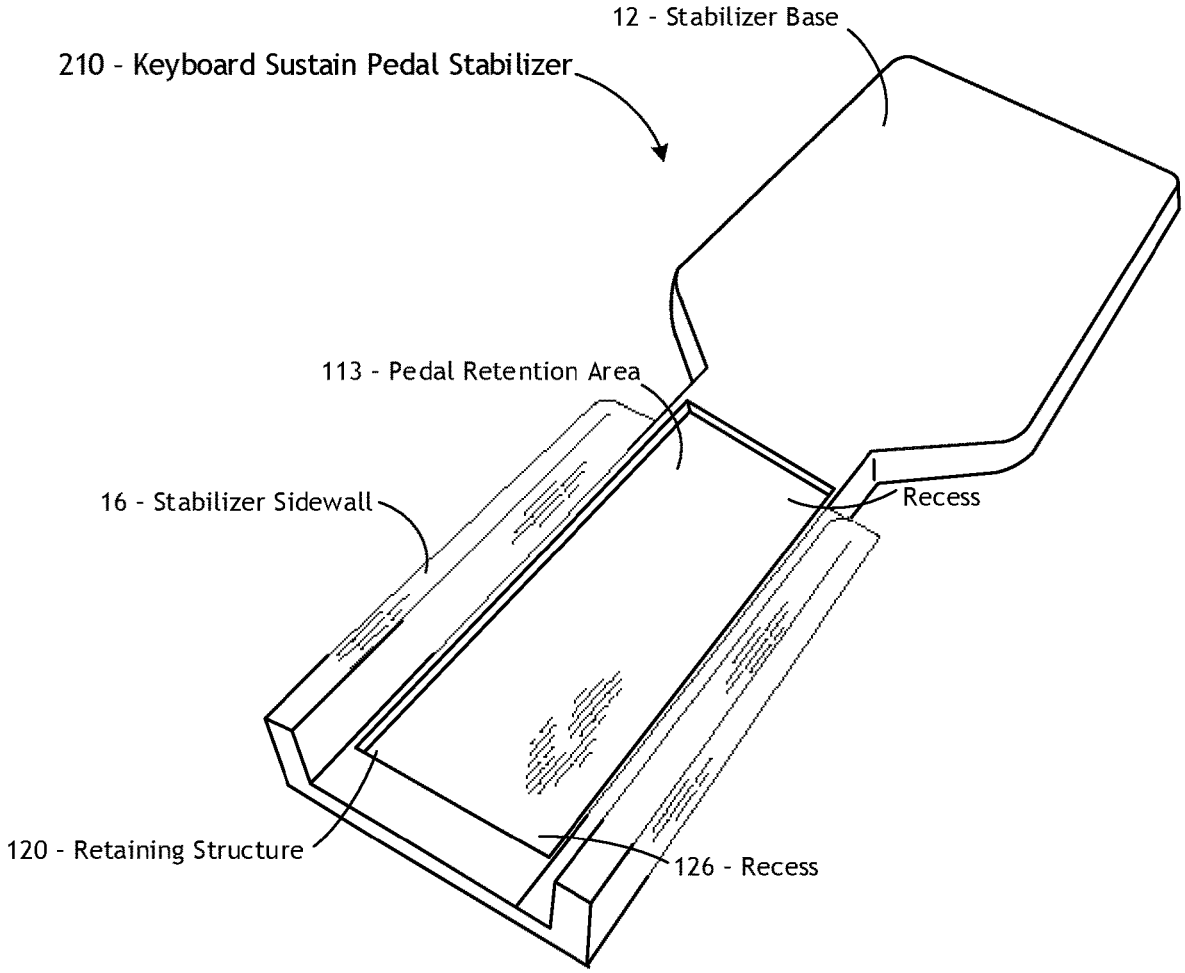
FIG. 11 depicts an assembly view of the keyboard sustain pedal stabilizer of FIG. 10.
Figure 12:
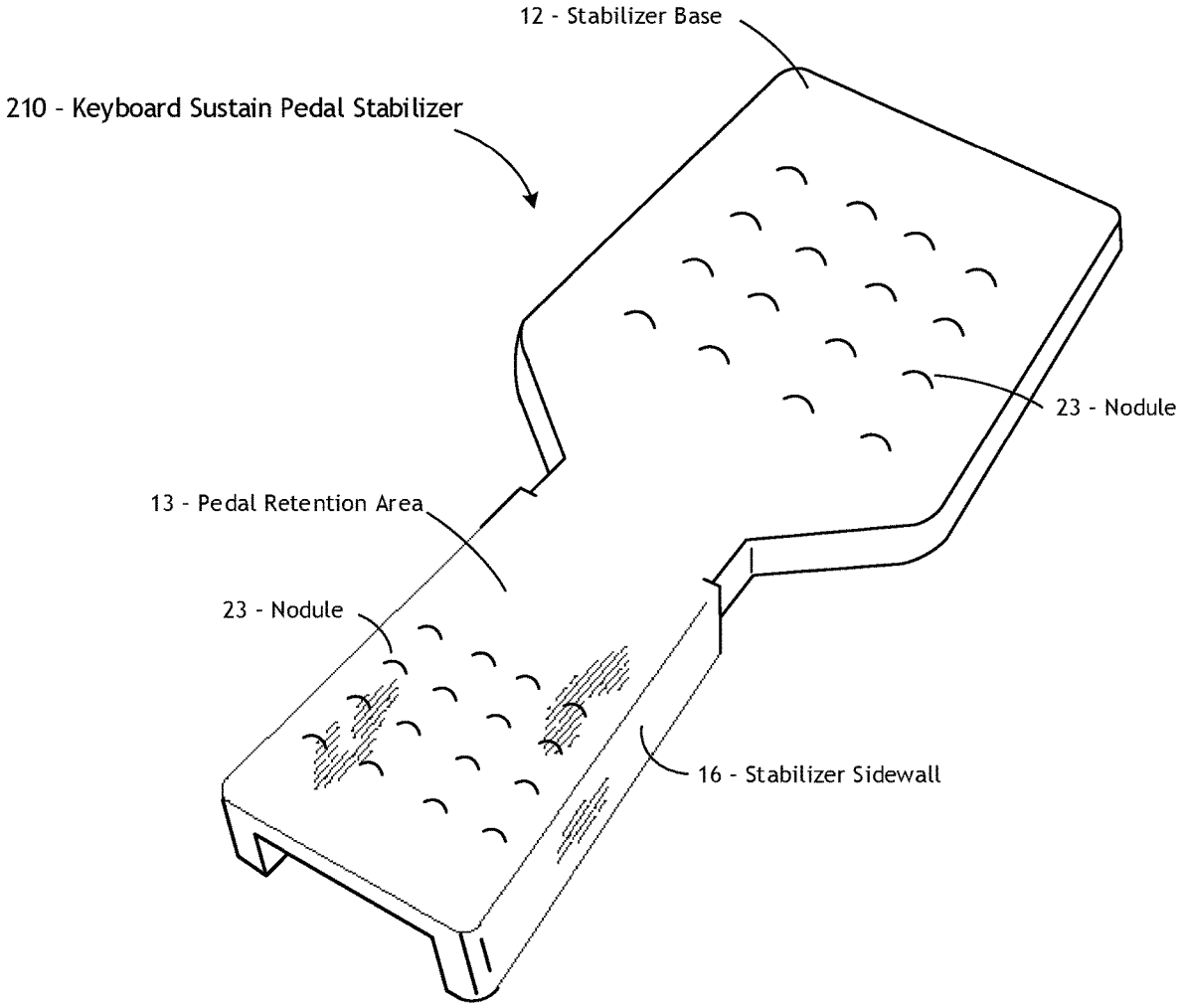
FIG. 12 depicts a bottom view of the keyboard sustain pedal stabilizer of FIG. 10.
Figure 13:
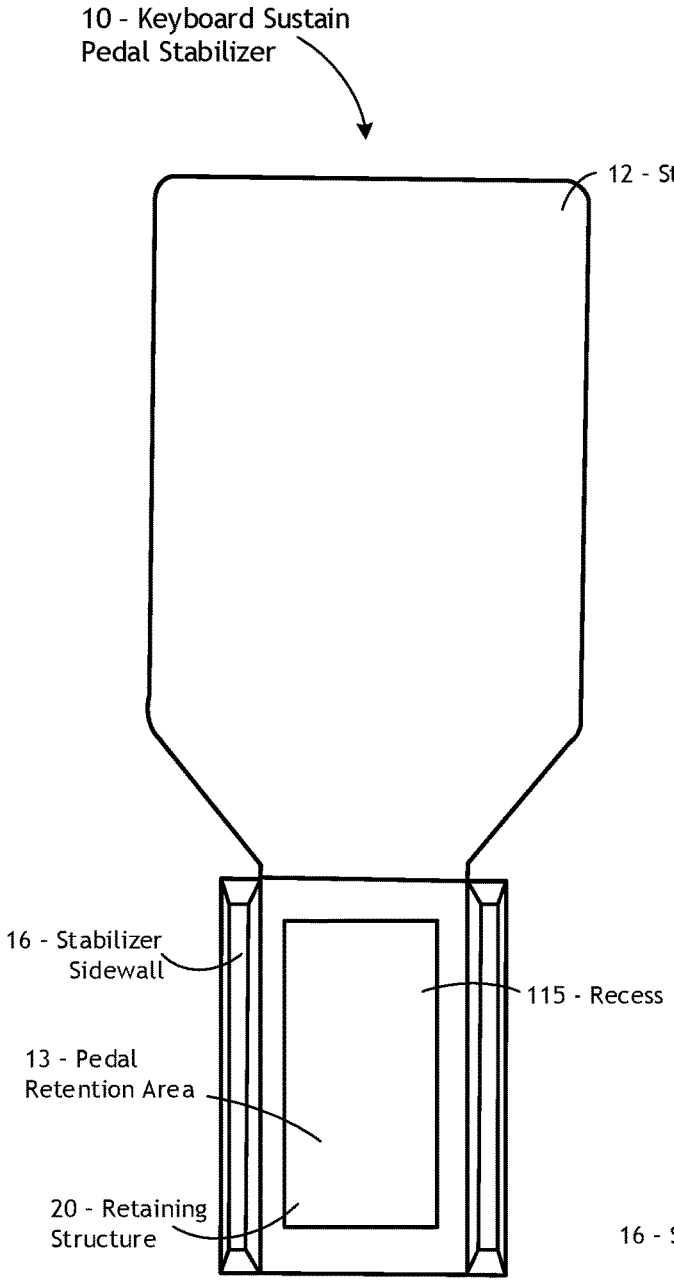
FIG. 13 depicts a top view of the keyboard sustain pedal stabilizer of FIG. 10.
Figure 14:
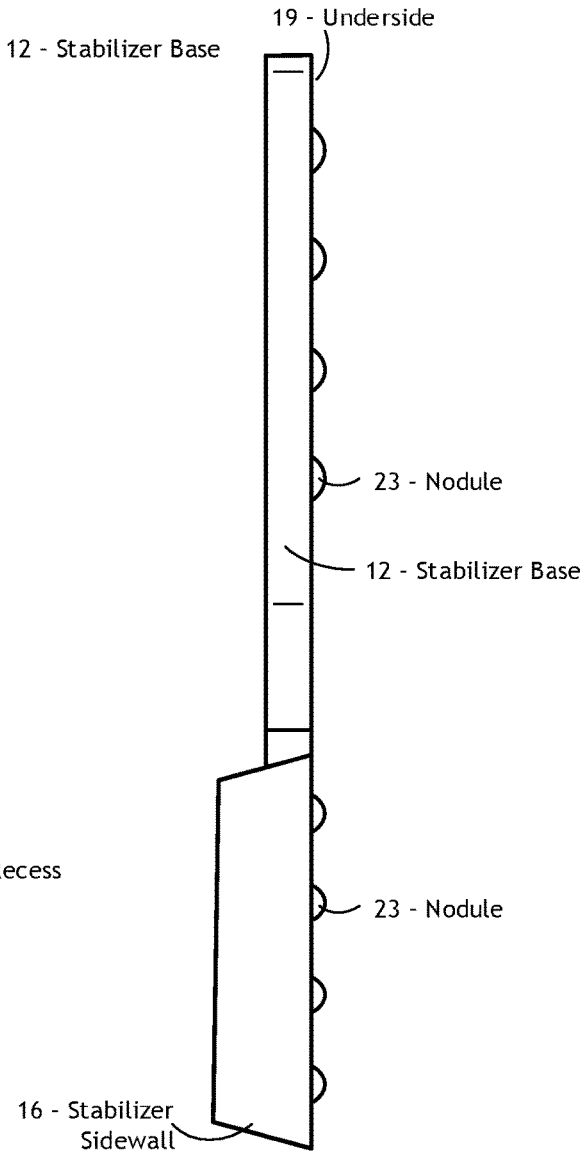
FIG. 14 depicts a side view of the keyboard sustain pedal stabilizer of FIG. 10.

FIG. 10 depicts an assembly view of a keyboard sustain foot pedal [34] mounted upon a third preferred embodiment the keyboard sustain pedal stabilizer [210] of the present invention. FIG. 11 depicts an assembly view of the keyboard sustain pedal stabilizer [210] of FIG. 10. FIG. 12 depicts a bottom view of the keyboard sustain pedal stabilizer [210] of FIG. 10.

FIG. 10 depicts the keyboard sustain foot pedal [34] (in phantom) positioned in a recess [126] that is part of a retaining structure [120] on the keyboard sustain pedal stabilizer [210]. FIG. 11 depicts the keyboard sustain pedal stabilizer [210] with the keyboard sustain foot pedal [34] removed from the recess [126] within the pedal-retaining structure [120].

Here again, the retaining structure is a recess [126] in pedal retention area [13] which prevents the keyboard sustain foot pedal [34] from sliding backward over the pedal retention area [13] during use.

The pedal-retention frame area [13], the pair of sidewalls [16], and the end-walls [22] are preferably made of a single piece of polymer material, which are preferably a plurality of rows of aligned nodules [23] protruding upwardly on the underside of the stabilizer base [12] and the pedal retention area [13]. Also, the keyboard sustain pedal stabilizer of the present invention [210] preferably has a non-slip underside [19] comprising a plurality of nodules [23] on the stabilizer base [12] and the pedal retention area [13].

In another preferred embodiment, the under-layer that contacts with a floor is made of a wear-resistant, anti-skid polymer such as a polyurethane, a styrene butadiene copolymer, or a polycarbonate. Other materials suitable for forming the bottom layer include acrylic terminated aromatic polyurethanes and epoxides. The bottom layer could generally be cross-linked highly (e.g., 10-50 mole percent), and its glass transition temperature, when measurable, could be below 5 degrees C. and in any case below 10 degrees C. The bottom layer could be formed to have a high surface energy, so that it does not lose all affinity to a floor surface even in the presence of a film of water on the floor surface.

In another preferred embodiment of the present invention, the keyboard sustain pedal stabilizer is made deploying conventional 3D print technology. There are different 3D printing technologies and materials that can be used, but all are based on the principle that a digital model is turned into a solid three-dimensional physical object by adding material layer by layer. In addition, 3D printing does not require tools and molds.

Such processes are well-known in the art as shown on-line at 3D Printing Tutorial: 3D Printing from SketchUp" (https://all3dp.com/best-3d-printing-tutorial/). See also U.S. Pat. No. 10,005,126 (Page), U.S. Pat. No. 9,977,840 (Makeig); U.S. Pat. No. 9,498,902 (Bodet et al.); and U.S. Pat. No. 9,393,724 (Olaru).

U.S. Pat. No. 9,498,902 (Bodet et al.) discloses a press for manufacturing a one-piece object and method for using said press. A press for manufacturing a one-piece object includes two rotary plates which are parallel but offset, each carrying a mold having two portions. Each mold portion can be placed above or below, so that the mold portion of the first mold situated above faces the mold portion of the second mold situated below. First parts of the object, for example skirts, are inserted in the press in an insertion zone. In parallel, second parts, for example caps, are introduced into an introduction zone. In a common zone, third parts, for example dispensing heads, are over-molded on the first and second parts brought close in the common zone in the same position as in the finished object. After opening the press, the plates are turned so that the finished objects are in the portion of the second mold.

U.S. Pat. No. 9,393,724 (Olaru) discloses a multi shot injection molding apparatus. The multi shot injection molding apparatus comprises a stationary machine platen, a first mold plate, a first injection unit connected to a first mold plate for delivering a first molding material to a plurality of first molding cavities, a movable machine frame, a carrier coupled to a movable machine platen, a second mold plate, a second injection unit for delivering a second molding material to a plurality of second molding cavities, a rotary handling unit having a first plurality of rotary handling unit mold cavity portions n and a second plurality of rotary handling unit mold cavity portions, wherein the rotary handling unit is positionable in a first position and is configured to remove the first portions of the molded parts, a first locking mechanism, a second locking mechanism, a processing station and an ejection station.

Throughout this application, various patents and applications are referenced by number and inventor. The disclosures of these documents in their entireties are hereby incorporated by reference into this specification to more fully describe the state of the art to which this invention pertains.

It is evident that many alternatives, modifications, and variations of the keyboard sustain pedal stabilizer of the present invention will be apparent to those skilled in the art in lieu of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Keyboard Sustain Pedal Stabilizer—1$^{st}$ Embodiment
12. Stabilizer Base
13. Pedal Retention Area
16. Stabilizer Support Sidewall
19. Underside
20. Retaining Structure
21. Stabilizer Seam
22. Stabilizer End-Wall
23. Nodule
24. Notch
34. Keyboard Sustain Foot Pedal
36. Pedal Cord
38. Pedal Ballast
40. Hinge
110. Keyboard Sustain Pedal Stabilizer—2$^{nd}$ Embodiment
113. Pedal Retention Area
115. Recess
210. Keyboard Sustain Pedal Stabilizer—3$^{rd}$ Embodiment

I claim:

1. A keyboard sustain pedal stabilizer for use with a keyboard sustain foot pedal, said keyboard sustain pedal stabilizer comprising:
- a stabilizer base;
- a pedal-retention area in cooperative engagement relative to said stabilizer base, said pedal-retention area including a retaining structure, said retaining structure enabling secure retention of said keyboard sustain foot pedal within said pedal retention area; and
- a hinge affixing said stabilizer base to said pedal-retention area, said hinge enabling rotation between said stabilizer base and said pedal-retention area.

2. The keyboard sustain pedal stabilizer of claim 1, wherein said keyboard sustain pedal stabilizer is made of a natural rubber material, a synthetic rubber material, or a blend of one or more natural rubber materials and one or more synthetic rubber materials.

3. The keyboard sustain pedal stabilizer of claim 1, wherein said retaining structure is an end-wall.

4. The keyboard sustain pedal stabilizer of claim 3, wherein said end-wall is disposed between a pair of sidewalls.

5. The keyboard sustain pedal stabilizer of claim 1, wherein said retaining structure includes a recess positioned in said pedal-retention area.

6. The keyboard sustain pedal stabilizer of claim 5, wherein said recess is positioned in said pedal-retention area between a pair of sidewalls.

7. The keyboard sustain pedal stabilizer of claim 1, wherein said keyboard sustain pedal stabilizer is made of a polymer, said stabilizer base having an underside, said underside having a non-slip surface.

8. The keyboard sustain pedal stabilizer of claim 1, wherein said keyboard sustain pedal stabilizer having an expanded position and a retracted position, said expanded position being for cooperative engagement with said keyboard sustain foot pedal.

9. The keyboard sustain pedal stabilizer of claim 1, wherein said keyboard sustain pedal stabilizer having an expanded position and a retracted position, said retracted position being for transporting said keyboard sustain pedal stabilizer.

10. The keyboard sustain pedal stabilizer of claim 1, wherein said hinge is attached to a bottom surface of said stabilizer base.

11. A keyboard sustain pedal stabilizer for use on a floor of a venue with a keyboard sustain foot pedal, said keyboard sustain pedal stabilizer comprising:
- a flat base section attached to a pedal-retention area;
- a recess within said flat base section, said recess securely retaining and stabilizing said keyboard sustain foot pedal within said keyboard sustain pedal stabilizer; and
- an underside of said keyboard sustain pedal stabilizer having a non-slip surface for stabilization of said keyboard sustain pedal stabilizer with said floor of said venue.

12. The keyboard sustain pedal stabilizer of claim 11, wherein said keyboard sustain pedal stabilizer is made of a natural rubber material, a synthetic rubber material, or a blend of one or more natural rubber materials and one or more synthetic rubber materials.

13. The keyboard sustain pedal stabilizer of claim 12, wherein said underside is compatible with a floor surface of said venue, said venue having varying textures and hardnesses to provide a non-slip engagement with said floor surface.

14. The keyboard sustain pedal stabilizer of claim 11, wherein said underside is formed of a high surface energy material that maintains affinity to a floor surface even in the presence of a film of water on said floor surface.

15. The keyboard sustain pedal stabilizer of claim 11, wherein said underside is made of a wear-resistant, anti-skid polymer.

16. A keyboard sustain pedal stabilizer for use with a keyboard sustain foot pedal, said keyboard sustain pedal stabilizer comprising:

a flat base section attached to a pedal-retention area; and a retaining structure in said flat base section, a recess being part of said flat base section, said recess securely retaining and stabilizing said keyboard sustain foot pedal within said keyboard sustain pedal stabilizer, said keyboard sustain pedal stabilizer having an underside, said underside having a non-slip surface including a plurality of nodules protruding from said underside of said base.

17. The keyboard sustain pedal stabilizer of claim 16, wherein said pedal-retention area is disposed between a pair of sidewalls.

18. The keyboard sustain pedal stabilizer of claim 16, wherein said underside is compatible with a floor surface of said venue, said venue having varying textures and hardnesses to provide a non-slip engagement with said floor surface.

19. The keyboard sustain pedal stabilizer of claim 16, wherein said keyboard sustain pedal stabilizer has an expanded position and a retracted position, said retracted position being for transporting said keyboard sustain pedal stabilizer.

20. The keyboard sustain pedal stabilizer of claim 16, wherein said keyboard sustain pedal stabilizer is made of a natural rubber material, a synthetic rubber material, or a blend of one or more natural rubber materials and one or more synthetic rubber materials.

* * * * *